US006290145B1

(12) United States Patent
Mizushima et al.

(10) Patent No.: US 6,290,145 B1
(45) Date of Patent: Sep. 18, 2001

(54) SPRAY UNIT THAT ATOMIZES LIQUID AT THE START OF THE SPRAY OPERATION

(75) Inventors: Hiroshi Mizushima; Katsuhito Kuwahara, both of Tokyo; Masami Chiku; Risa Iwata, both of Yokohama, all of (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/424,536

(22) PCT Filed: Mar. 30, 1999

(86) PCT No.: PCT/JP99/01644

§ 371 Date: Feb. 17, 2000

§ 102(e) Date: Feb. 17, 2000

(87) PCT Pub. No.: WO99/51360

PCT Pub. Date: Oct. 14, 1999

(30) Foreign Application Priority Data

Mar. 30, 1998 (JP) ..... 10-102109

(51) Int. Cl.[7] ..... B05B 7/30

(52) U.S. Cl. ..... 239/353; 239/337; 222/321.9; 222/631

(58) Field of Search ..... 239/337, 340, 239/353, 354; 222/318, 321.9, 321.3, 401, 631, 137, 375, 321.7

(56) References Cited

U.S. PATENT DOCUMENTS 4,179,049 * 12/1979 Umstead ..... 222/631
5,110,052 * 5/1992 Graf et al. ..... 239/337
5,350,116 * 9/1994 Cater ..... 222/631
5,443,569 * 8/1995 Uehira et al. ..... 222/321.9
5,570,819 * 11/1996 Uehira et al. ..... 222/321.9
5,752,627 * 5/1998 Vandromme et al. ..... 222/631

FOREIGN PATENT DOCUMENTS

Y2-7-33900 8/1995 (JP) .
A-8-230961 9/1996 (JP) .

* cited by examiner

*Primary Examiner*—David A. Scherbel
*Assistant Examiner*—Christopher S. Kim
(74) *Attorney, Agent, or Firm*—Oliff & Berridge, PLC

(57) ABSTRACT

A spray unit that is attached to an opening at a neck portion of a container for spraying a liquid material in the container, including: a cylinder unit composed of a large-diameter air cylinder and a small-diameter liquid cylinder having a valve hole and an operating member. The operating member is composed of a large-diameter cylindrical piston, a stem having a check valve, and a press-down head having a spray nozzle hole. The liquid is to be sprayed when the operating member is pressed down. When the operating member is pressed down, a liquid flow-out path and an air ejecting path come together via a small gap inside the spray nozzle hole. The spray unit further includes a flow rate control valve is composed of a valve seat provided at an upper face of a valve hole of the liquid cylinder and a valve body arranged above the valve seat to be seated on or released from the valve seat. At least one of the valve seat and the valve body is provided with a small flow path that is not closed even when the valve body sits on the valve seat and that always communicates the interior of the container with the interior of the liquid cylinder, and the flow rate control valve is provided with a large flow path that is opened when the valve body is released from the valve seat and closed when the valve body sits on the valve seat. The sectional area of the small flow path is smaller than an open area of the valve hole of the air cylinder and that of the valve hole of the check valve provided inside the stem. The combination overcomes the delay in ejecting the liquid.

8 Claims, 3 Drawing Sheets

SPRAY UNIT THAT ATOMIZES LIQUID AT THE START OF THE SPRAY OPERATION

BACKGROUND OF THE INVENTION

1. Field of the Invention

The invention relates to apparatus for spraying liquid using a manually operated spray pump.

2. Description of the Related Art

JP-A8-230,961 discloses a suction type spray device which is used in the state that the device is fitted to an opening of a neck portion of a container and which has a structure for spraying a liquid material inside the container.

Such a suction type spray device has a cylinder unit including an upper large-diameter air cylinder hung into the container and a small-diameter liquid cylinder continued to a lower side of the air cylinder and an operating member including a large-diameter cylindrical piston gas-tightly and slidably held at an inner peripheral face of the large-diameter air cylinder. The spray device also has a stem that is gas-tightly engaged in the small-diameter liquid cylinder, upwardly urged and extended upwardly from the liquid cylinder, gas-tightly passing a central hole of the air cylinder, and provided with a check valve at an upper inner side thereof. The operating member has a press-down head fitted with an upper portion of the stem, having a lower end portion of a peripheral wall connected to the large-diameter cylindrical piston and provided with a spray nozzle hole at a tip portion thereof, a liquid flow-out path for communicating the interior of the stem with the spray nozzle of the press-down head, and an air ejecting path communicating the air cylinder with the spray nozzle hole of the press-down head. When the operating member is pressed down, air is ejected through the ejecting nozzle hole to suck the liquid in the container and spray it.

In a conventional vertical spray device, the liquid is sprayed while being rotated at a high speed. However, according to the conventional spray unit, as the air is ejected at a high speed, a negative pressure is generated due to the high speed of the air. The suction is necessary to suck the liquid, mix it with the air and atomize the liquid. Therefore, this method is useful in that even a liquid having a relatively high viscosity is easily atomized, but there is a problem in that the mixture of air and liquid does not begin to spray until after air is continuously ejected for a while by pressing down the operating member, so that the start of the ejection of the liquid is delayed.

Although the factor which delays the start of the spraying of the air/fuel mixture is not clear, it is necessary that the air reaches a given high speed so as to suck out the liquid through the suction created by the air, and that a given time is required for the air speed to reach the high speed.

SUMMARY OF THE INVENTION

The invention is a spray unit which solves the problems of the above-mentioned conventional suction type spray unit and which can feed an appropriate amount of a liquid to an air ejecting path almost simultaneously with ejection of air instead of sucking the liquid with only a negative pressure. Due to the ejection of air, the liquid is mixed into the air and sprays the resulting mixture of air/liquid through a spray nozzle.

A spray unit according to the invention is used in a gas-tight state attached to an opening at a neck portion of a container for spraying a liquid material in the container. The spray unit has a cylinder unit and an operating member.

The cylinder unit is adapted to be hung inside the container and includes an upper large-diameter air cylinder and a small-diameter liquid cylinder connected to the lower side of the air cylinder. The cylinder unit has, at a lower end portion, a valve hole to communicate with an interior of the container;

The operating member has a large-diameter gas-tight cylindrical piston slidably held at an inner peripheral face of the large-diameter air cylinder, a gas and liquid tight stem engaged in the small-diameter liquid cylinder, upwardly urged and extended upwardly from the liquid cylinder and gas-tightly passing a central hole of the air cylinder, and a press-down head fitted to an upper portion of the stem, having a lower end portion of a peripheral wall connected to the large-diameter cylindrical piston and provided with a spray nozzle hole at a tip portion thereof. The liquid flow-out path and an air-ejecting path come together via a small gap inside the spray nozzle. The liquid is sprayed when the operating member is pressed down, wherein the stem has in it a liquid flow path communicating with the valve hole of the liquid cylinder, a check valve that allows the liquid to flow from a lower side to an upper side only is provided midway in the liquid flow path, a liquid reservoir portion is defined upward of the check valve inside the stem, and the liquid reservoir communicates with the liquid flow-out path via a through-hole.

An air flow path is provided between an interior of the air cylinder and the air ejecting path of the press-down head, an air introduction path is provided between the interior of the air cylinder and the outside of the spray unit. When the operating member is pressed down, the air flow path communicates the interior of the air cylinder with the air ejecting path of the press-down head to eject air through the spray nozzle; when the press-down head is positioned in an upper, non-pressed down location, communication between the interior of the air cylinder and the air ejecting path of the press-down head is interrupted. On the other hand, when the press-down head is positioned in the upper, non-pressed down location, the air introduction path communicates the interior of the air cylinder with the outside of the spray unit; when the operating member is pressed down, communication between the interior of the air cylinder and the outside of the spray unit is interrupted, thereby pressurizing air inside the air cylinder.

The spray unit also includes a flow rate control valve which comprises a valve seat provided at an upper face of a surrounding of the valve hole of the liquid cylinder and a valve body that is positioned above the valve seat and to be seated on or released from the valve seat, at least one of the valve seat and the valve body is provided with such a small flow path that is not closed even when the valve body is seated on the valve seat and that always communicates the interior of the container with the interior of the liquid cylinder, and the flow rate control valve is provided with such a large flow path that is opened when the valve body is released from the valve seat and closed when the valve body seats the valve seat; a sectional area of the small flow path is smaller than an open area of the valve hole of the air cylinder and that of the valve hole of the check valve provided inside the stem.

When the operating member is pressed down, high pressure is applied to the interior of the air cylinder and the liquid cylinder, a part of the liquid inside the liquid cylinder can be returned into the container through the small flow path, an appropriate amount of the liquid can be atomized and mixed into the air ejected in the small gap through which the air ejecting path and the liquid flow-out path come together, and the atomized mixture of air and the liquid can be ejected through the nozzle hole; and when the press-down head is upwardly moved to the upper, non-pressed down location, the liquid is fed to the liquid flow path inside the stem through the always non-closed small flow path and the large flow path. The feature "continued to a lower side of the air cylinder" in the above not only involves the case where the air cylinder is formed integrally with the liquid cylinder, but also the case where the air cylinder and the liquid cylinder are separately formed and connected to each other to form the cylinder unit.

According to the spray unit of the invention, when the operating member is pressed down, the cylindrical piston and the stem are moved downward, applying pressure inside the air cylinder and the liquid cylinder, the interior of the air cylinder and the air ejecting path are connected to each other through the air flow path to eject pressurized air from the air cylinder through the spray nozzle hole. At that time, the valve body of the flow rate control valve sits on the valve seat to cloth the large flow path, a part of the liquid inside the liquid cylinder is returned to the interior of the container through the small flow path, an appropriate amount of the liquid filled in the liquid reservoir portion is pushed out and fed into the liquid flow-out path through the through-hole. This appropriate amount of the liquid is mixed and atomized into the air ejected into the small space through which the air ejecting path and the liquid flow-out path come together, and the atomized mixture of the air and the liquid is ejected through the nozzle hole.

Since the liquid can be always kept filled in the liquid reservoir portion by the provision of the first check valve inside an upper portion of the stem, pressure is applied to the liquid cylinder and the first check valve is opened simultaneously when the operating member is pressed down.

Further, when the operating member is pressed down, pressurized air inside the air cylinder immediately ejects through the air ejecting path. Therefore, it does not take a time until the liquid is atomized and ejected after the start of the ejection of air, different from the above-mentioned liquid suck-out/ejecting mechanism. Furthermore, when the press-down head moves to the upper, non-pressed down position, the valve body leaves the valve seat to form the large flow path, and the liquid is supplemented to the liquid flow path inside the stem through the always non-closed small flow path and the large flow path. In this way, the above-mentioned delay in ejecting the liquid can be overcome. Therefore, the phenomenon that the liquid and air cannot be mixed or atomized due to an excess amount of the liquid supplied at the time of the air ejection, as occurs in a spray device in which the liquid is sprayed under a high speed rotation, can be avoided.

A first exemplary embodiment of the invention uses spray unit described above, wherein the small flow path is a groove bored in the valve seat of the flow rate control valve. A second exemplary embodiment uses spray unit as described above, wherein the valve body is formed by a lower end portion of a poppet valve extending in the liquid cylinder and operationally connected to the stem, and an outer peripheral surface of the poppet valve constitutes a seating face for the valve seat. A third exemplary embodiment uses a spray unit as described above, wherein the small flow path is a through-hole bored at the outer peripheral surface of the poppet valve in a position from a lower end face thereof above a level of the seating face. A fourth exemplary embodiment of the invention uses the spray unit described above, wherein a lower end of an urging means for upwardly urging the stem is mounted on an outer peripheral portion of the poppet valve.

A fifth exemplary embodiment of the invention uses a plurality of vertically extending support plates that are provided along the inner circumference of the lower end portion A plurality of vertically extending engaging projections are provided circumferentially an outer surface of the lower end portion of the poppet valve. The projections project from the outer surface of the lower end portion of the poppet valve such that the engaging projections are to be vertically movably fitted in respective gaps between adjacent support plates.

A sixth exemplary embodiment of the invention uses a plurality of vertically extending support plates. The vertically extending support plates are provided on the inner circumference of the lower end portion. A plurality of vertically extending engaging projections are provided on an outer circumference of the lower end portion of the poppet valve. The projections are projecting from the outer surface of the lower end portion of the poppet valve such that the engaging projections are vertically movable in the respective gaps between adjacent support plates. An upward step is formed at the upper portion of each of the support plates, and a spring for urging the stem is placed on the upward step of each of the support plates; an upper end portion of the poppet valve is of an elastic semi-spherical shape in which the poppet valve is opened in diameter in a conical form that matches a recess formed at the upper end face thereof. A projection is provided on the inner surface of the stem at such a position that an outer face of the upper portion of the semi-spherical portion is pressed against the projection when the stem is moved to its upper limit. In this state a peripheral portion of the upper portion of the projection is pressed liquid-tightly against the outer face of the upper portion of the semi-spherical portion. When the poppet valve is pulled up, the upper faces of the engaging projections are press contactable with the lower end face of the spring; and a second check valve is constituted by the projection and the semi-spherical portion.

BRIEF DESCRIPTION OF THE DRAWINGS

Various exemplary embodiments of the invention are described in detail with reference to the following figures, wherein like numbers reference like elements, and wherein.

DETAILED DESCRIPTION OF EXEMPLARY EMBODIMENTS

Figure 1:
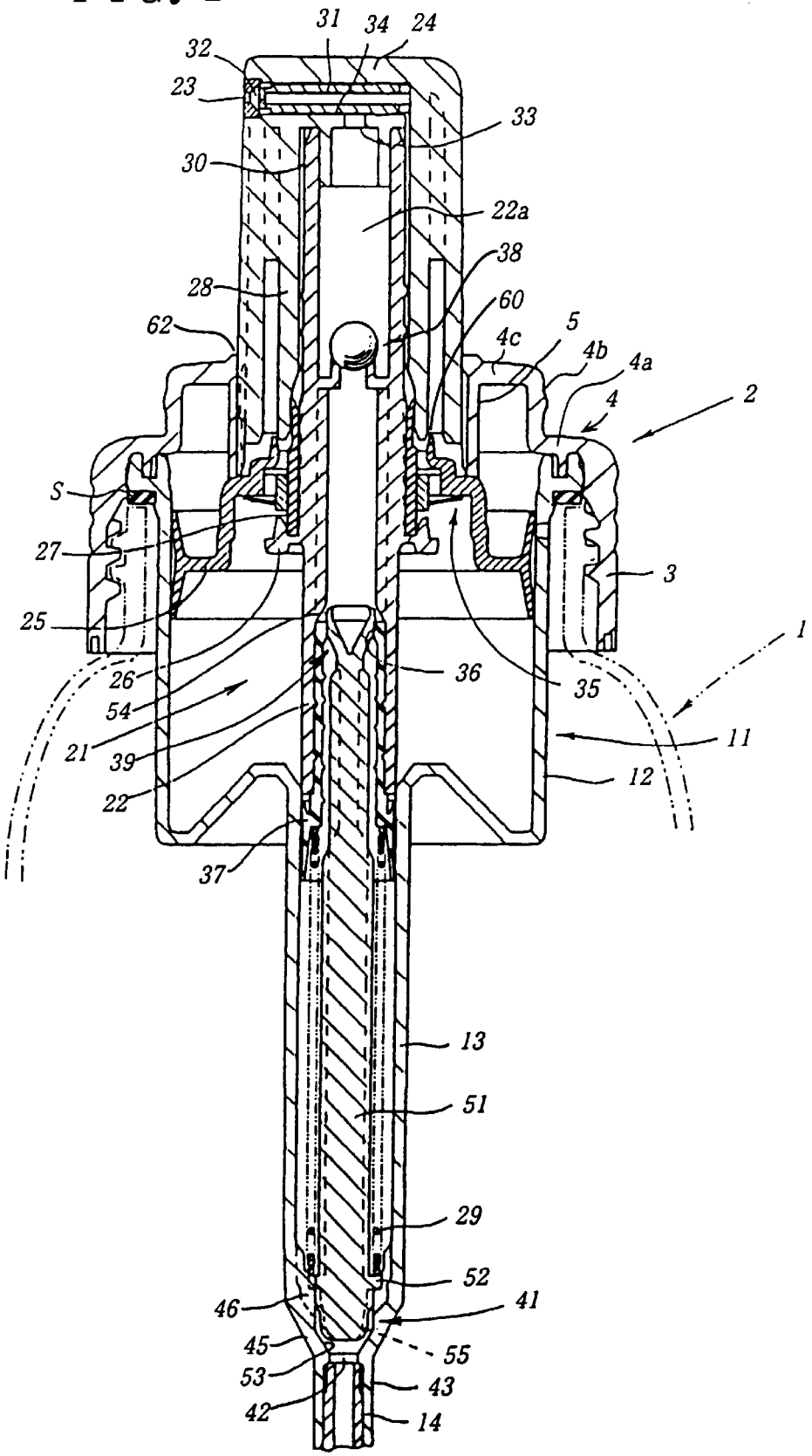
FIG. 1 is a vertical cross-sectional view of a spray unit as one embodiment according to the invention, which is attached to an opening of a neck portion of a container.

FIG. 1 is a sectional view of a principal portion of a spray device formed by attaching a spray unit according to the invention to an opening at a neck portion of a container 1. The spray unit is attached to the opening at the neck portion of the container 1 by means of a cap-shaped member 2. The cap-shaped member 2 includes a peripheral wall portion 3 screwed to an outer peripheral face of the neck portion of the container 1, a flanged top wall portion 4, and a stop cylindrical portion 5. The flanged top wall portion 4 including an annular portion 4*a* extending radially inward from an upper end of the peripheral wall portion 3, a cylindrical portion 4*b* extending axially outward from an inner peripheral portion of the annular portion 4*a*, and an annular portion 4*c* extending radially inward from an upper end of the cylindrical portion. The stop cylindrical portion 5 extends axially inward from an inner end portion of the annular portion 4*c*. The stop cylindrical portion 5 contacts an upper face of a large-diameter annular/cylindrical piston 35, and stops upward movement of the piston 35.

The spray unit includes a cylindrical member 11 and an operating member 21. The cylindrical member 11 includes an upper large-diameter air cylinder 12 and a liquid cylinder 13 extending under the air cylinder. The liquid cylinder 13 is connected to an inner peripheral face of a flange-shaped bottom wall portion extending radially inward from a lower end portion of the air cylinder 12. A flange, which extends radially from an upper end of the air cylinder 12, is held between an upper end face of the neck portion of the container 1 and the annular portion 4*a* of the top wall portion 4 via a seal member "S", creating a gas tight seal. A valve hole 42 is provided at a lower end portion of the liquid cylinder 13, and a suck-up pipe 14, which extends down to an inner bottom portion of the container 1, is connected to the lower end portion of the liquid cylinder.

The operating member 21 extends axially outward from the cylinder 11 through the cap-shaped member 2, and includes a large-diameter cylindrical piston 25, a stem 22 and a cylindrical press-down head 24. An outer peripheral portion of the large-diameter cylindrical piston 25 is brought into gas-tight and slidable contact with an inner peripheral face of the air cylinder. The stem 22 has a lower portion fitted into the small-diameter liquid cylinder 13, forming a gas and liquid tight seal. The stem 22 is upwardly urged and extends up from the liquid cylinder 13, and gas-tightly passes a central hole of the large-diameter cylindrical piston 25. The stem contains a liquid flow path in which is provided, at an upper portion, a check valve allowing the liquid to flow from lower to upper sides only. A liquid reservoir portion 22*a* is defined above a first check valve 38 within the liquid flow path.

The press-down head 24 has a cylindrical shape with an upper end sealed. A lower end portion of a peripheral wall of the press-down head 24 is fitted into the stop cylinder 5 of the cap-shaped member, and connected to an upper surface of the large-diameter cylindrical piston 25. On the other hand, the stem 22 is fixed inside a cylindrical hollow space inside the press-down head 24 in the state that a gap 30 is defined between the outer peripheral face of the stem 22 and an inner peripheral face of the press-down head. An ejecting pipe 31 is located within the upper end portion of the press-down head 24 in which an air ejecting path is formed. A spray nozzle hole 23 is provided at an outward opening of the ejecting pipe 31. The spray nozzle portion 23 communicates with the liquid reservoir portion 22*a* of the stem 22 via a liquid ejecting path formed by a groove provided at an outer surface of the ejecting pipe 31 and a through-hole 33 provided in a lower wall of the upper end portion of the press-down head. A receiving seat 26 is provided at an outer peripheral portion in a central portion of the stem 22, and a vertical cylindrical member 27 is provided at an inner peripheral portion of the cylindrical piston 25, so that a lower end portion of the vertical cylindrical member 27 is supported by the receiving seat 26. An upper portion of the vertical cylindrical member 27 is fitted slidably into a cylindrical space defined by an inner peripheral face of the lower end of the peripheral wall of the press-down head and the outer peripheral face of the stem 22.

The operating member 21 is pressed down inside the liquid cylinder 13, and is raised through being urged with the spring 29. When the operating member 21 is pressed down, the cylindrical piston 25 descends to pressurize the air inside the air cylinder 12. The pressurized air is ejected through the nozzle 23 via the gap defined between the inner face of the vertical cylinder 27, the inner peripheral face of the peripheral wall 28 of the press-down head and the outer peripheral face of the stem 22 and the ejecting pipe 31 within in the upper portion of the press-down head 24. When the pressurized air is ejected, the small gap 32 defined between a front end of the ejecting pipe and the inner face of the nozzle hole 23 is subjected to a negative pressure, so that the liquid inside the liquid reservoir 22*a* is sucked out through the liquid flow-out path defined by the groove 34 formed at the outer peripheral face of the ejecting pipe 31 and through-hole 33 bored at the top wall of the press-down head 24. The liquid sucked out is atomized and mixed into the air, and the mixture is ejected through the nozzle 23. The design may be modified so that the air ejecting path is formed by the groove 34 formed at the outer surface of the ejecting pipe, and the liquid flow-out path by the hole of the ejecting pipe 31.

An air discharge valve is formed by a lower end face of the vertical cylinder 27 and an upper face of the receiving seat 26. As the operating member 21 descends, the air discharge valve is opened, and the valve is closed as the operating member rises. At an inner peripheral portion of the large-diameter piston 25 is provided an exterior air suck-in valve 35 which opens as the operating member 21 rises to introduce exterior air through a gap 60 and a gap 62 between the outer peripheral surface of the stem and a radially innermost end of cap member 2 and closes as the operating member 21 descends.

A flow rate control valve 41, which includes a large flow path and a small flow path, is provided in a lower end portion of the liquid cylinder. The small flow path is always open irrespective of the valve being opened or closed, whereas the large flow path is opened when the valve is opened, and closed when the valve is closed. FIGS. 2 to 5 show specific embodiments of such flow rate control valve 41.

Figure 2:
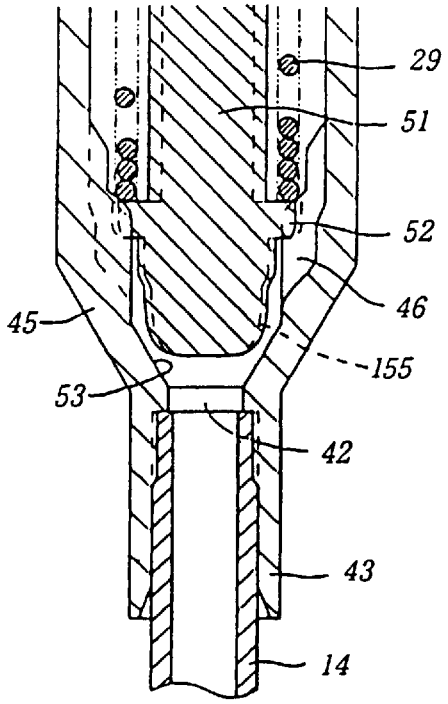
FIG. 2 is an enlarged cross-sectional view of a flow control valve of the spray unit shown in FIG. 1.

FIG. 2 is an enlarged sectional view of the flow rate control valve 41 and its vicinity in FIG. 1. A valve hole 42 is provided at a lower end of the liquid cylinder, and a liquid suction pipe-fitting cylinder 43 is hung from the lower end of the liquid cylinder, surrounding the valve hole. An upper end portion of the suction pipe 14 fitted into fitting cylinder 43.

The lower end portion of the liquid cylinder above the valve hole 42 is designed as a taper portion 45 which opens upwardly and outward. A plurality of vertically extending, rib-shaped support plates 46 are provided circumferentially over the inner face of the taper portion and that of a lower portion of the liquid cylinder above the taper portion. Each support plate 46 has, at a middle portion of the inner side face, an upper step on which the lower end of the spring 29 is placed to urge the stem upwardly. A poppet valve 51 is vertically movably fitted in the liquid cylinder, and an upper portion of the poppet valve is loosely inserted into a lower portion of the stem 22. A plurality of engaging projections 52 are provided at a lower portion of the poppet valve, and each of the projection 52 is loosely fitted between the adjacent support plates 46. As the poppet valve 51 rises, the projections 52 engage with the lower end of the spring 29, whereas the operating member 21 descends, an outer peripheral portion of the lower end of the poppet valve contacts a valve seat 53 formed by the inner peripheral face of the taper portion under the support plates.

An upper portion of the poppet valve 51 is designed in the form of a semi-spherical portion 54 of which diameter increases upwardly with a recess at a upper end face. The semi-spherical portion engages with an upper face of a projection 36 provided at an inner peripheral face of the stem, so that when the stem rises, the projection pulls up the poppet valve via the semi-spherical portion. In FIG. 1, a lower portion of the stem is constituted by double cylinders, and the projection is provided circumferentially at an upper end portion of an inner cylinder, and a lower end portion of the inner cylinder is designed as a small-diameter piston 37 that engages with an inner wall face of the liquid cylinder 13.

A second check valve 39 is formed by the semi-spherical portion 54 and the projection 36. The second check valve 39 opens when the operating member 21 descends. The structures of the poppet valve 51, the projection 36 and the second check valve 39 are almost identical with those in the known suck-out spray unit.

An outer peripheral face of the lower end portion of the poppet valve 51 is bored with a plurality of vertically extending grooves 155, which form the small flow path that communicates with the valve hole 42 with the inside the liquid cylinder even when the poppet valve 51 descends. The poppet valve 51 is closed with the outer peripheral face of its lower end portion sitting on the valve seat 53. The total sectional area of the small flow path constituted by the plural grooves 155 is designed smaller than the sectional area of each of the valve hole 42 at the lower end of the liquid cylinder, the pipe hole of the suction pipe 14, and the valve hole of the first check valve 38 inside the upper portion of the stem 22. That is, when the poppet valve 51 rises, the liquid enters the liquid cylinder 13 in an amount greater than that of the liquid passing the small flow path, whereas when the liquid inside the liquid cylinder 13 and the stem 22 flows down into the container, only a small amount of the liquid passing the small flow path flows through the flow rate control valve 41.

Figure 3:
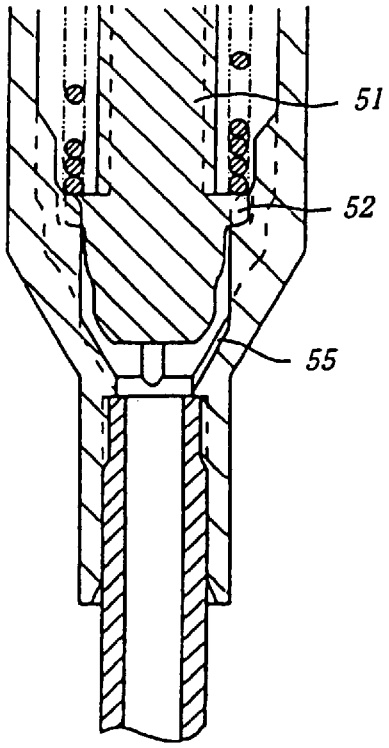
FIG. 3 is a vertical cross-sectional view of a flow control valve of a spray unit as another embodiment according to the invention.

In an embodiment of FIG. 3, instead of boring a plurality of the grooves 155 at the outer peripheral face of the lower end portion of the poppet valve 51, a plurality of vertically extending grooves 55 are bored at a side of the valve seat of the liquid cylinder 13 to form a small flow path.

Figure 4:
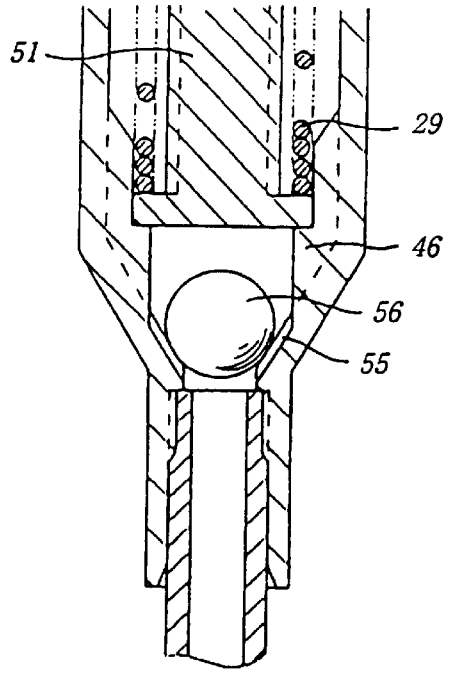
FIG. 4 is a vertical cross-sectional view of a flow control valve of a spray unit as a further embodiment according to the invention.

In an embodiment shown in FIG. 4, a valve body is designed as a spherical valve body 56, and grooves 55 for the formation of a small flow path is provided at a side of a valve seat of the liquid cylinder similarly in the embodiment of FIG. 3. In the embodiment of FIG. 4, a stationary rod 57 is used instead of the poppet valve. An outward flange is provided at a lower end portion of the stationary rod 57, and is placed on an upward steps of the support plates 46. Onto the outward flange is press contacted the spring 29 for urging the stem. An upper portion of the stationary rod 54 has the same construction as that of the poppet valve 51.

Figure 5:
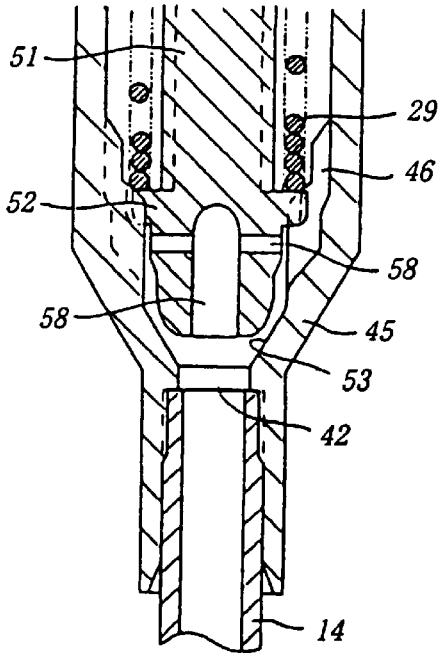
FIG. 5 is a vertical sectional view of a flow control valve of a spray unit as a still further embodiment according to the invention.

In an embodiment shown in FIG. 5, a through-hole 58 as a small flow path is bored in such a form that the through-hole extends from a lower end face of the poppet valve 51 to its outer periphery above the valve seat portion. In this embodiment, when the poppet valve sits on the valve seat, the poppet valve and the valve seat 53 liquid-tightly contacts with each other, but the liquid inside the liquid cylinder flows down into the container through the through-hole 58 and the valve hole 42 because the through-hole acts as the small flow path.

In each of the above embodiments, when the operating member 21 is vertically moved plural times relative to the cylinder member 11, the liquid flows into the stem 22 above the first check valve 38. As shown in FIG. 1, when the operating member is located in its upper limit position, the first check valve 38 and the second check valve 39 are closed, whereas the flow rate control valve 41 is opened. As the operating member is pressed down from this state, as mentioned above, air inside the air cylinder 12 is pressurized with descending the large-diameter cylindrical piston 25, and the pressurized air is ejected through the air discharge valve constituted by the lower end face of the vertical cylinder 27 and the receiving seat 26, the gap 30, the air ejecting path, and the air nozzle hole 23. On the other hand, as the stem descends, the liquid inside the liquid cylinder 13 is subjected to a high pressure upon receipt of pressure, so that a part of the liquid inside the liquid reservoir is pushed out and supplied into the small gap 32 defined between the front end face of the ejecting pipe 31 and the inner face of the nozzle hole 23 through the liquid flow-out path 34. As a result, air and the liquid ejected are mixed and atomized, and ejected through the nozzle hole 23. At that time, when the operating member 21 is pressed down, the stem 22 descends to press downwardly the poppet valve 51 and sit it on the valve seat 53. However, since the small flow path is kept opened, excess liquid is returned into the container through the small flow path.

When the descending of the operating member 21 stops, the first check valve 38 closes. Following this, as the operating member and accordingly the stem 22 rise, a negative pressure is created inside the liquid cylinder, the poppet valve 51 rises to open the flow rate control valve 41. The open flow rate control valve 41 allows the liquid inside the container to flow into the liquid cylinder. When the operating member reaches its upper limit, the second check valve 39 is closed.

If the second check valve 39 is provided such that the upper end portion of the poppet valve 51 is designed as an elastic semi-spherical portion 54 having a large outer diameter and that an upper outer face of the above semi-spherical portion is brought into liquid-tight press contact with the upper peripheral portion of the projection 36 provided circumferentially at the inner face of the stem when the upwardly urged operating member rises, the liquid does not leak through the stem and the liquid flow-out path even if the container falls down.

What is claimed is:

1. A spray unit that is gas-tightly attached to an opening at a neck portion of a container, comprising:

a cylinder unit hung inside the container, comprising:

an upper large-diameter air cylinder; and a small-diameter liquid cylinder connected to a lower side of the large diameter air cylinder and having, at a lower end portion, a valve hole to communicate with an interior of the container;

an operating member comprising:

a large-diameter cylindrical piston gas-tightly and slidably held at an inner peripheral face of the large-diameter air cylinder;

a gas and liquid tight stem engaged in the small-diameter liquid cylinder, upwardly urged and extended upwardly from the liquid cylinder and gas-tightly passing a central hole of the air cylinder, comprising:

a liquid flow path communicating with the valve hole of the liquid cylinder;

a first check valve midway in the liquid flow path that allows a liquid to flow from a lower side to an upper side only;

a liquid reservoir portion upward of the first check valve inside the stem; and a through hole that connects the liquid reservoir portion and a liquid flow-out path;

a press-down head fitted to an upper portion of the stem, having a lower end portion of a peripheral wall connected to the large-diameter cylindrical piston, comprising:

a spray nozzle hole at a tip portion;

the liquid flow-out path; and an air-ejecting path, the air-ejecting path and the liquid flow-out path coming together via a small gap inside the spray unit;

an air flow path connecting an interior of the air cylinder and the air ejecting path of the press-down head;

an air introduction path connecting the interior of the air cylinder and the outside of the spray unit, such that when the operating member is pressed down, the air flow path allows communication between the interior of the air cylinder and the air ejecting path of the press-down head to eject air through the spray nozzle; when the press-down head is positioned in an upper, non-pressed down location, communication between the interior of the air cylinder and the air ejecting path of the press-down head is interrupted; when the press-down head is positioned in the upper, non-pressed down location, the air introduction path allows communication between the interior of the air cylinder and the outside of the spray unit; and when the operating member is pressed down, communication between the interior of the air cylinder and the outside of the spray unit is interrupted, thereby pressurizing air inside the air cylinder;

a flow rate control valve which comprises:

a valve seat provided at an upper face of a surrounding of the valve hole of the liquid cylinder; and a valve body that is positioned above the valve seat;

a small flow path that is not closed even when the valve body is seated on the valve seat and always allows communication between the interior of the container with the interior of the liquid cylinder; and a large flow path that is opened when the valve body is released from the valve seat and closed when the valve body is closed and a sectional area of the small flow path is smaller than an open area of the valve hole of the liquid cylinder and that of a valve hole of a second check valve provided inside the stem, such that when the operating member is pressed down, high pressure is applied to the interior of the air cylinder and the liquid cylinder, a part of the liquid inside the liquid cylinder can be returned into the container through the small flow path, an appropriate amount of the liquid can be atomized and mixed into the air ejected in a small gap through which the air ejecting path and the liquid flow-out path come together, and the atomized mixture of air and the liquid can be ejected through the nozzle hole; and when the press-down head is upwardly moved to the upper, non-pressed down location, the liquid is fed to the liquid flow path inside the stem through the small flow path and the large flow path.

2. The spray unit claimed in claim 1, wherein the small flow path is a groove bored in the valve seat of the flow rate control valve.

3. The spray unit claimed in claim 1, wherein the valve body further comprises:

a lower end portion of a poppet valve extending in the liquid cylinder that is operationally connected to the stem, and an outer peripheral surface of the poppet valve is a seating face for the valve seat.

4. The spray unit claimed in claim 3, wherein the small flow path is a through-hole bored at the outer peripheral surface of the poppet valve in a position from a lower end face thereof to a level above the seating face.

5. The spray unit claimed in claim 3, wherein a lower end of an urging means for upwardly urging the stem is mounted on an outer peripheral portion of the poppet valve.

6. The spray unit claimed in claim 3, further comprising:

a plurality of circumferential vertically extending support plates at an inner surface of the lower end portion of the liquid cylinder, each of the support plates having an upward step formed at an upward portion;

a plurality of vertically extending engaging projections at an outer surface of the lower end portion of the poppet valve, projecting from the outer surface of the lower end portion of the poppet valve such that the engaging projections are vertically movable in respective gaps between adjacent support plates;

a spring for urging the stem is placed on the upward step of each of the support plates; where an upper end portion of the poppet valve is of an elastic semi-spherical shape in which the poppet valve is upwardly opened in diameter in a conical form and a recess is formed at an upper end face thereof; and a projection is provided at an inner surface of the stem at such a position that an outer face of the upper portion of the semi-spherical portion is press contacted with the projection when the stem is moved to its upper limit, in this state a peripheral portion of an upper portion of the projection is liquid-tightly contacted with the outer face of an upper portion of the semi-spherical portion, when the poppet valve is pulled up, upper faces of the engaging projections are contactable with a lower end face of the spring; and the second check valve is constituted by the projection and the semi-spherical portion.

7. The spray unit claimed in claim 2, wherein the valve body has a lower end portion of a poppet valve extending in the liquid cylinder and operationally connected to the stem, and an outer peripheral surface of the poppet valve constitutes a seating face for the valve seat.

8. The spray unit claimed in claim 4, further comprising:

a plurality of vertically extending support plates provided circumferentially at an inner surface of the lower end portion of the liquid cylinder; and a plurality of vertically extending engaging projections provided circumferentially to an outer surface of the lower end portion of the poppet valve, such that the engaging projections are vertically movable in respective gaps between adjacent support plates.

* * * * *